US009541357B2

(12) United States Patent
Klement

(10) Patent No.: US 9,541,357 B2
(45) Date of Patent: Jan. 10, 2017

(54) HIGH VISIBILITY AMMUNITION CASINGS

(71) Applicant: Daniel L. Klement, Gainesville, TX (US)

(72) Inventor: Daniel L. Klement, Gainesville, TX (US)

( * ) Notice: Subject to any disclaimer, the term of this patent is extended or adjusted under 35 U.S.C. 154(b) by 0 days.

(21) Appl. No.: 14/507,536

(22) Filed: Oct. 6, 2014

(65) Prior Publication Data

US 2015/0020706 A1 Jan. 22, 2015

Related U.S. Application Data

(60) Division of application No. 13/113,553, filed on May 23, 2011, now abandoned, which is a continuation of application No. 29/372,059, filed on Oct. 8, 2010, now Pat. No. Des. 652,476, and a continuation of application No. 29/372,056, filed on Oct. 8, 2010, now Pat. No. Des. 652,473, and a continuation of application No. 29/372,057, filed on Oct. 8, 2010, now Pat. No. Des. 652,474, and a continuation of application No. 29/372,058, filed on Oct. 8, 2010, now Pat. No. Des. 652,475, and a continuation of application No. 29/372,061, filed on Oct. 8, 2010, now Pat. No. Des. 652,477, and a continuation of application No. 29/372,060, filed on Oct. 8, 2010, now Pat. No. Des. 652,888, and a continuation of application No. 29/370,642, filed on Aug. 14, 2010, now Pat. No. Des. 652,472.

(51) Int. Cl.

| | |
|---|---|
| ***F42B 5/26*** | (2006.01) |
| ***F42B 5/295*** | (2006.01) |
| ***F42B 5/307*** | (2006.01) |
| ***F42B 5/02*** | (2006.01) |

(52) U.S. Cl.
CPC ..... *F42B 5/26* (2013.01); *F42B 5/025* (2013.01); *F42B 5/295* (2013.01); *F42B 5/307* (2013.01)

(58) Field of Classification Search
CPC ..... F42B 5/00; F42B 5/02; F42B 5/025; F42B 5/188; F42B 5/26; F42B 5/28; F42B 5/295; F42B 5/297; F42B 5/30; F42B 5/307; F42B 5/313; F42B 7/00; F42B 7/02; F42B 7/04; F42B 7/06; F42B 7/10; F42B 7/12; F42B 8/02; F42B 8/04; F42B 8/08; F42B 8/10
USPC .... 102/430, 448, 464, 465, 466, 467; 86/10, 86/11, 19.5, 1.1
See application file for complete search history.

(56) References Cited

U.S. PATENT DOCUMENTS

| | | | |
|---|---|---|---|
| 34,950 | A | 4/1862 | James |
| D57,978 | S | 5/1921 | Kavan |
| D77,862 | S | 2/1929 | Schwarzkopf |
| D77,987 | S | 3/1929 | Schwarzkopf |
| D79,335 | S | 9/1929 | Juede |
| 3,176,614 | A | 4/1965 | Woodring |
| 3,399,622 | A | 9/1968 | Houdek |
| 3,623,431 | A | 11/1971 | Hendricks |

(Continued)

OTHER PUBLICATIONS

In the U.S. Patent and Trademark Office, Office Action in re: U.S. Appl. No. 13/113,553, dated Jul. 20, 2011, 6 pages.

(Continued)

*Primary Examiner* — James S Bergin
(74) *Attorney, Agent, or Firm* — Porzio, Bromberg & Newman P.C.

(57) ABSTRACT

Ammunition casings are described that include a base, a body coupled to the base, and one or more patterns on the body.

17 Claims, 6 Drawing Sheets

(56) References Cited

U.S. PATENT DOCUMENTS

| | | | | |
|---|---|---|---|---|
| 3,901,158 | A | 8/1975 | Ferb | |
| 3,906,859 | A * | 9/1975 | Smith | F42B 5/025 102/444 |
| 4,065,541 | A | 12/1977 | Eckstein et al. | |
| 4,109,401 | A * | 8/1978 | Musgrave | F41A 9/62 42/1.01 |
| 4,120,628 | A | 10/1978 | Simos | |
| 4,233,903 | A | 11/1980 | Lage | |
| 4,574,701 | A | 3/1986 | Fiocchi | |
| 5,359,937 | A | 11/1994 | Dittrich | |
| 5,415,151 | A * | 5/1995 | Fusi | F42B 12/72 124/1 |
| 5,685,100 | A | 11/1997 | Atchison | |
| 6,149,705 | A | 11/2000 | Lowden et al. | |
| 6,250,008 | B1 * | 6/2001 | Silver | F41A 17/44 42/70.01 |
| 6,672,219 | B2 * | 1/2004 | Mackerell | F42B 5/295 102/430 |
| 6,889,612 | B1 | 5/2005 | Liaw et al. | |
| 7,014,284 | B2 * | 3/2006 | Morton | B41J 3/4073 347/4 |
| 7,415,929 | B1 * | 8/2008 | Faughn | F42B 7/08 102/448 |
| 7,914,841 | B2 | 3/2011 | Eells et al. | |
| D652,472 | S | 1/2012 | Klement | |
| D652,473 | S | 1/2012 | Klement | |
| D652,474 | S | 1/2012 | Klement | |
| D652,475 | S | 1/2012 | Klement | |
| D652,476 | S | 1/2012 | Klement | |
| D652,477 | S | 1/2012 | Klement | |
| D652,888 | S | 1/2012 | Klement | |
| 8,402,896 | B1 * | 3/2013 | Hollerman | F42B 12/38 102/458 |
| 2004/0237828 | A1 | 12/2004 | Epstein | |
| 2006/0201374 | A1 | 9/2006 | de Aguiar | |
| 2007/0084375 | A1 | 4/2007 | Smith | |
| 2009/0090235 | A1 | 4/2009 | Brunn | |
| 2009/0283056 | A1 * | 11/2009 | Mattera | A01K 27/006 119/858 |
| 2010/0037794 | A1 | 2/2010 | Authement, Sr. | |
| 2011/0016760 | A1 * | 1/2011 | Longo | F41A 9/65 42/49.01 |
| 2011/0017090 | A1 | 1/2011 | Menefee, III | |
| 2012/0037029 | A1 | 2/2012 | Klement | |
| 2012/0199033 | A1 * | 8/2012 | Bybee | F42B 5/02 102/442 |

OTHER PUBLICATIONS

In the U.S. Patent and Trademark Office, Requirement for Restriction/Election in re: U.S. Appl. No. 13/113,553, dated Nov. 18, 2011, 6 pages.

In the U.S. Patent and Trademark Office, Final Office Action in re: U.S. Appl. No. 13/113,553, dated Feb. 4, 2013, 9 pages.

In the U.S. Patent and Trademark Office, Requirement for Restriction/Election in re: U.S. Appl. No. 13/113,553, dated May 28, 2013, 6 pages.

In the U.S. Patent and Trademark Office, Office Action in re: U.S. Appl. No. 13/113,553, dated Oct. 9, 2013, 8 pages.

In the U.S. Patent and Trademark Office, Final Office Action in re: U.S. Appl. No. 13/113,553, dated Jun. 6, 2014, 5 pages.

* cited by examiner

HIGH VISIBILITY AMMUNITION CASINGS

CROSS-REFERENCE TO RELATED APPLICATIONS

This application is a divisional of U.S. patent application Ser. No. 13/113,553, filed May 23, 2011, which is a continuation of U.S. Design patent application No. 29/370,642, filed Aug. 14, 2010, now U.S. Pat. No. D652,472; U.S. Design patent application No. 29/372,056, filed Oct. 8, 2010, now U.S. Pat. No. D652,473; U.S. Design patent application No. 29/372,057, filed Oct. 8, 2010, now U.S. Pat. No. D652,474; U.S. Design patent application No. 29/372,058, filed Oct. 8, 2010, now U.S. Pat. No. D652,475; U.S. Design patent application No. 29/372,059, filed Oct. 8, 2010, now U.S. Pat. No. D652,476; U.S. Design patent application No. 29/372,060, filed Oct. 8, 2010, now U.S. Pat. No. D652,888; U.S. Design patent application No. 29/372,061, filed Oct. 8, 2010, now U.S. Pat. No. D652,477; the contents of which are incorporated by reference herein in their entireties.

FIELD OF THE INVENTION

The present invention relates to ammunition casing for recreational guns. It is particularly useful for shotgun shell casings that are easier to locate under the methods described in the invention.

BACKGROUND OF INVENTION

Hunting is a common recreational activity, especially in rural areas. Modern guns eject the spent shells from the rifle or pistol, often automatically or with a minimal effort by the hunter, e.g., pump shotgun. Often, in the excitement of the hunt or while pursuing wounded or fallen game, the exact location of the spent shell casing is difficult to determine. This presents a number of problems. In the case of common brass cartridges, the brass decomposes very slowly and may contain other residual pollutants such as lead. Shotgun shells are often even more difficult to recover and pose a particular problem for livestock, in addition to the problems with residual pollutants. Spent, conventional shotgun shells are hard to see in the camouflage of natural hunting grounds. Even if colored, these shotgun shells are difficult to detect by hunters. If left unrecovered, the shotgun shells become a hazard for livestock, especially cattle because the animals ingest the shell. The shotgun shells and other spent ammunition is a nuisance for landowners and harmful to the environment. This problem leads to fewer landowners who are willing to permit hunting on their property, with a concomitant loss of areas for hunters to hunt in. There is a long felt need to make location of these spent cartridges more efficient. While most of the drawings depict shotgun shells, it should be appreciated that the invention also contemplates the shells of other types of guns: recovering such items reduces pollution and increases the ease of recovery for such activities as reloading.

BRIEF DESCRIPTION OF THE DRAWINGS

The accompanying drawings, which are included to provide a further understanding of embodiments of the invention and are incorporated in and constitute a part of this specification, illustrate preferred embodiments of the invention and together with the detailed description serve to explain the principles of the invention. In the drawings.

DETAILED DESCRIPTION OF THE EMBODIMENTS

Figure 1A:
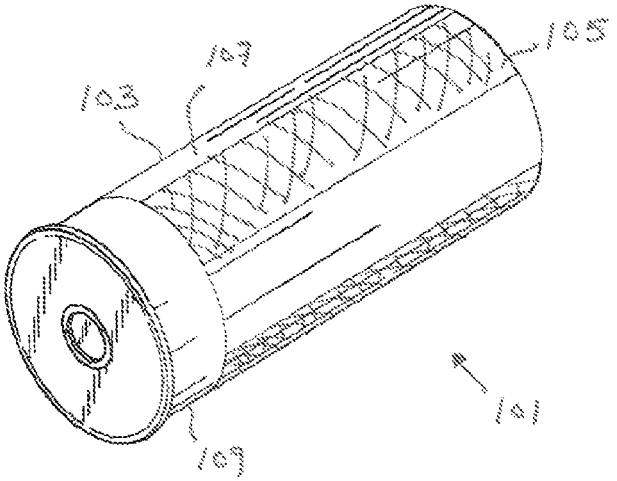
FIGS. 1A-1D show an exemplary shotgun shell with straight parallel stripes.

Embodiments of the present invention provide hunters with an easily recoverable spent ammunition casing, especially the shotgun hull, thus promoting stewardship of the land as well as setting a positive example for the future generations of hunters. Embodiments of the present invention may include shotgun shells made with highly visible patterns and/or colors that allow for easy pick-up in the field and subsequent disposal. The invention also contemplates using reflection as well as glow in the dark plastic. Such types of plastic can be used alone or with the highly visible patterns and/or colors.

Various types of materials and processes may be used to create the ammunition casings of the present invention. For example, extrusion and co-extrusion may be used where the desired properties are found in the plastic pellets used in the extrusion process.

In certain embodiments, a coating may be applied inline to a continuous tubing formed by extrusion, prior to cutting and secondary operations. Thus, inefficient and labor-intensive steps associated with preparing individual tubes for coating may be avoided. The method may include forcing a flowable material through an exit port of an extruder, depositing a coating onto at least a portion of the continuous length of extruded tubing after the tubing is forced through the exit port, cutting the coated tubing to a desired length after depositing the coating, and performing one or more secondary operations on the coated tube such as described in U.S. Pat. No. 7,914,841, which is incorporated by reference. More than one material may be co-extruded at a time to create various high-visibility patterns as described herein.

Apparatus for extruding plastic tubes, such as in shotgun shells, are well known in the art. The tubes may be substantially rigid, semi-flexible, or flexible, as desired. A spiral or helical tape or filament may be extruded, simultaneously with a plastic tube, whereby the resulting final product comprises a reinforcing helical skeleton, and an integral tube covering. The spiral or helical tape or filament is rotated as it is extruded, whereby the filament may be close together or relatively spacially separated, during extrusion, as for example, in the manufacture of a flexible hose. The diameter of the finished product can be readily varied, by simply adjusting the size of the extrusion collar in a method as set forth in U.S. Pat. No. 4,120,628, which is incorporated by reference. By using differing streams of plastic, straight or spiral patterns can easily be manufactured for incorporation into the brass or metal end of shotgun shells. Other easily visible patterns in addition to those set forth in the figures are contemplated. Any pattern that is more easily visible than the solid pattern is contemplated. Naturally, shells could be manufactured that were designed to be most visible under specific conditions that would change with the vegetation, season, or soil coloration.

The ammunition casings may also be painted, dyed or colored with ink, paint or other coloring substances based on properties of the coloring substance. Photoluminescent pigment and luminescent powder are available for various purposes. Plastic tubing, pellets and other raw materials may be available in various colors, including fluorescent, glow in the dark, luminescent, striped, etc. Reflective materials may include mirror or retroreflective materials, such as reflective beads or prisms.

Figure 1B:
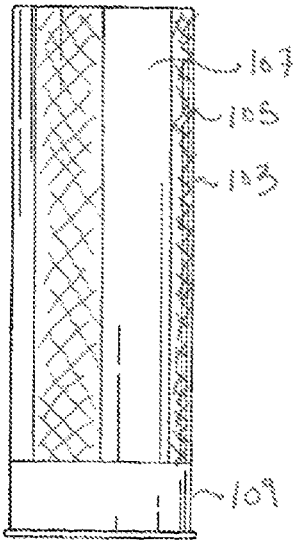
Figure 1C:
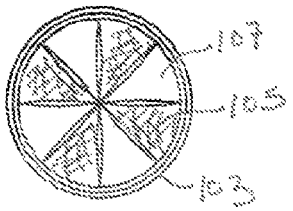
Figure 1D:
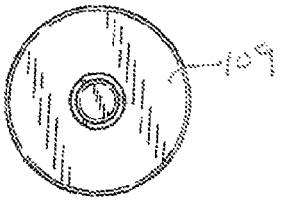

FIGS. 1A-1D show an exemplary shotgun shell 101 with straight parallel stripes on a body 103. The body 103 may be made of plastic or a similar material. One or more dark stripes 105 may be alternated or otherwise paired with one or more lighter stripes 107 to improve visibility. One or more of the stripes 105, 107 may be fluorescent, reflective, glow-in-the-dark, luminescent or simply colored. Preferably, the stripes 105, 107 are highly contrasting. The stripes 105, 107 may be of various shapes, sizes and proportions. The stripes 105, 107 may be molded with a desired optical characteristic or may be painted or otherwise treated to create the desired optical characteristic. A base 109 may be made of brass, steel or other suitable materials. A twelve gauge shotgun shell is shown, but all gauges of shotgun shells may be used as well as other shell types.

Figure 2A:
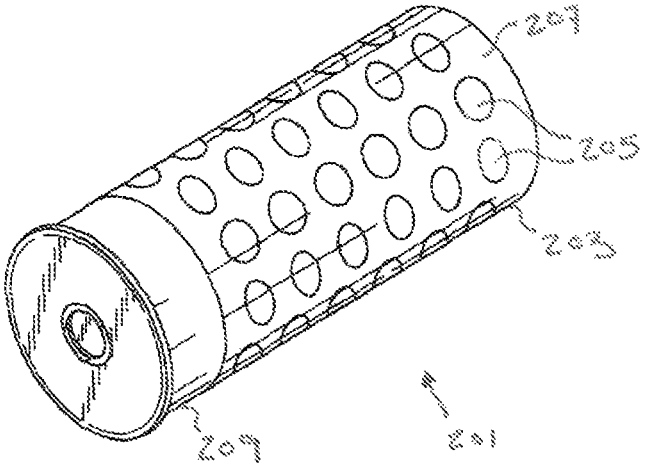
FIGS. 2A-2D show an exemplary shotgun shell with a dotted or spotted pattern.
Figure 2B:
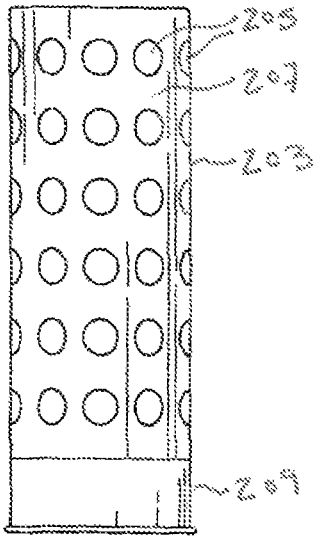
Figure 2C:
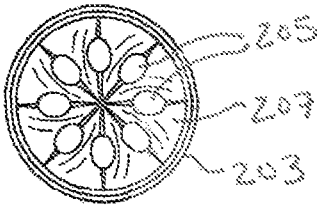
Figure 2D:
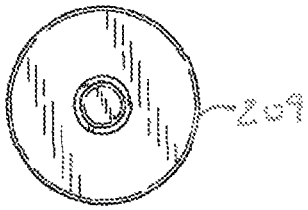

FIGS. 2A-2D show an exemplary shotgun shell 201 with a dotted or spotted pattern on a body 203. The body 203 may be made of plastic or a similar material. One or more dark dots or spots 205 may be regularly or randomly placed on a lighter background 207 to improve visibility. One or more of the dots or spots or background 205, 207 may be fluorescent, reflective, glow-in-the-dark, luminescent or simply colored. Preferably, the dots or spots and background 205, 207 are highly contrasting. The dots or spots 205 may be of various shapes, sizes and proportions. The dots or spots or background 205, 207 may be molded with a desired optical characteristic or may be painted or otherwise treated to create the desired optical characteristic. A base 209 may be made of brass, steel or other suitable materials. A twelve gauge shotgun shell is shown, but all gauges of shotgun shells may be used as well as other shell types.

Figure 3A:
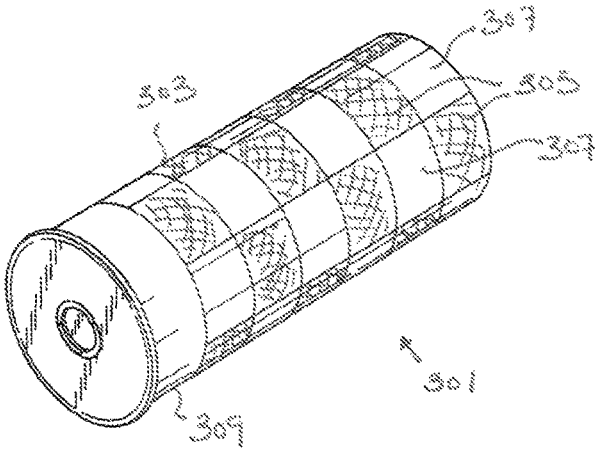
FIGS. 3A-3D show an exemplary shotgun shell with a check board pattern.
Figure 3B:
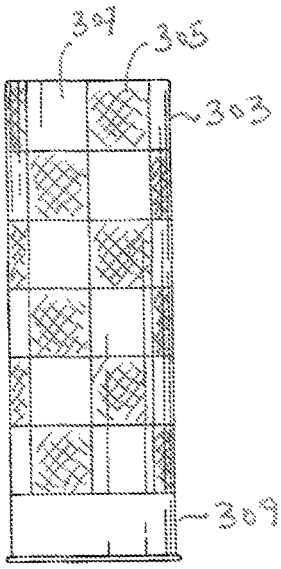
Figure 3C:
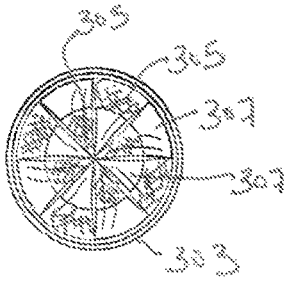
Figure 3D:
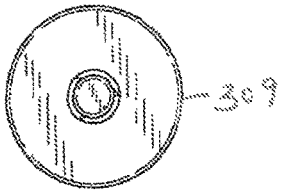

FIGS. 3A-3D show an exemplary shotgun shell 301 with a check board pattern on a body 303. The body 303 may be made of plastic or a similar material. One or more areas 305 may be alternated with one or more lighter areas 307 to improve visibility. One or more of the areas 305, 307 may be fluorescent, reflective, glow-in-the-dark, luminescent or simply colored. Preferably, the areas 305, 307 are highly contrasting. The stripes 305, 307 may be of various shapes, sizes and proportions. The areas 305, 307 may be molded with a desired optical characteristic or may be painted or otherwise treated to create the desired optical characteristic. A base 309 may be made of brass, steel or other suitable materials. A twelve gauge shotgun shell is shown, but all gauges of shotgun shells may be used as well as other shell types.

Figure 4A:
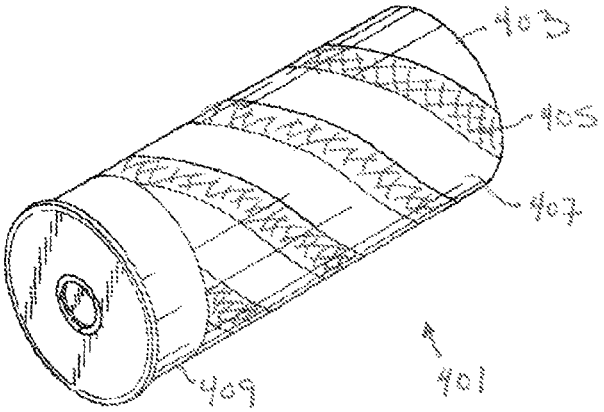
FIGS. 4A-4D show an exemplary shotgun shell with spiral stripes.
Figure 4B:
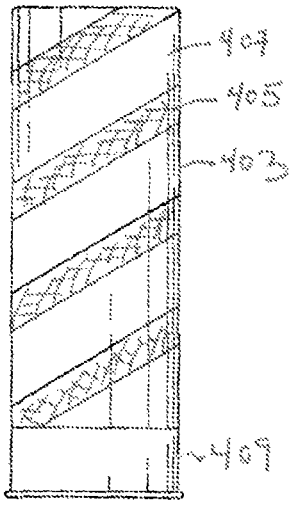
Figure 4C:
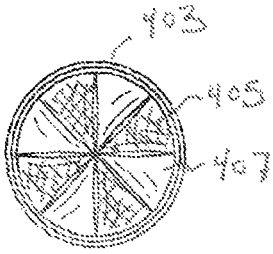
Figure 4D:
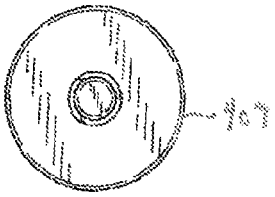

FIGS. 4A-4D show an exemplary shotgun shell 401 with spiral stripes on a body 403. The body 403 may be made of plastic or a similar material. One or more dark stripes 405 may be alternated or otherwise paired with one or more lighter stripes 407 to improve visibility. One or more of the stripes 405, 407 may be fluorescent, reflective, glow-in-the-dark, luminescent or simply colored. Preferably, the stripes 405, 407 are highly contrasting. The stripes 405, 407 may be of various shapes, sizes and proportions. The stripes 405, 407 may be molded with a desired optical characteristic or may be painted or otherwise treated to create the desired optical characteristic. A base 409 may be made of brass, steel or other suitable materials. A twelve gauge shotgun shell is shown, but all gauges of shotgun shells may be used as well as other shell types.

Figure 5A:
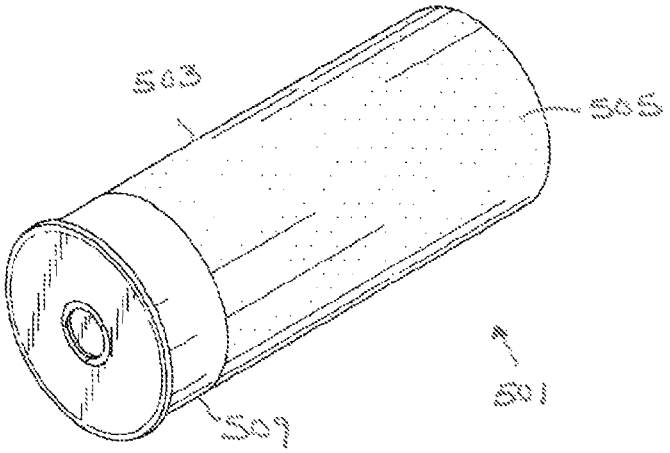
FIGS. 5A-5D show an exemplary shotgun shell with a highly reflective or luminescent body.
Figure 5B:
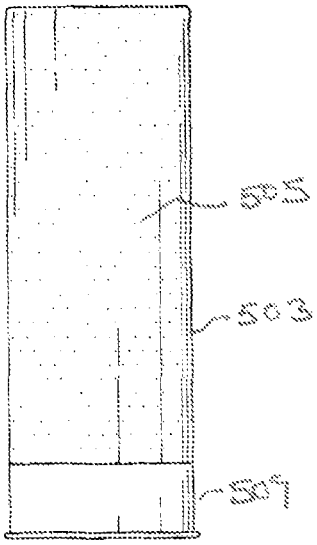
Figure 5C:
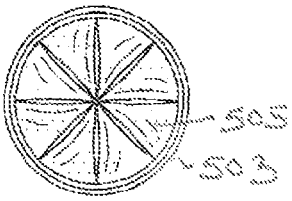
Figure 5D:
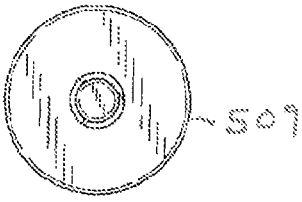
Figure 6A:
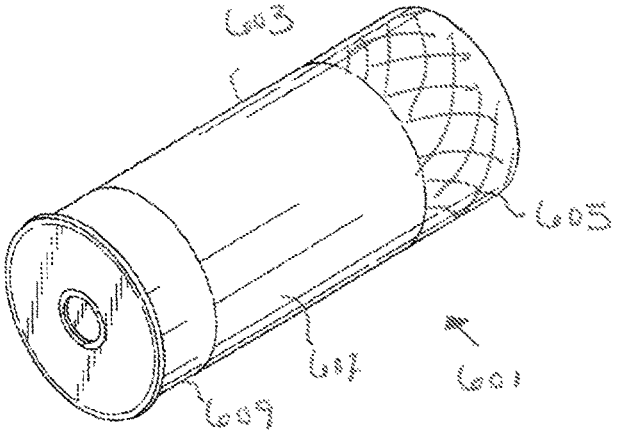
FIGS. 6A-6D show an exemplary shotgun shell with an end differently colored than a main body.
Figure 6B:
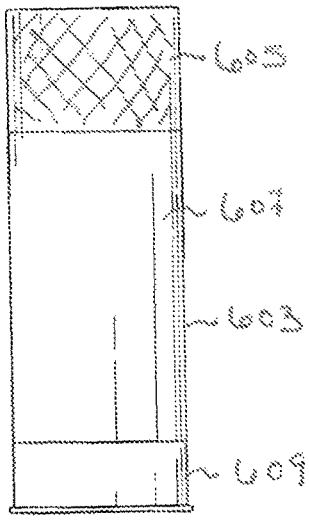
Figure 6C:
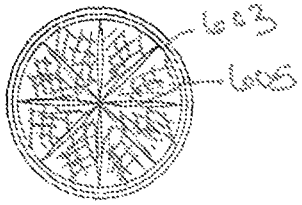
Figure 6D:
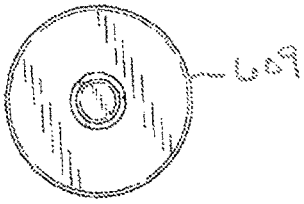

FIGS. 5A-5D show an exemplary shotgun shell 501 with a highly reflective or luminescent on a body 503. The body 503 may be made of plastic or a similar material. The body 503 may have one or more areas 505 that are highly reflective or luminescent to improve visibility. The one or more areas 505 may be fluorescent, reflective, glow-in-the-dark, luminescent or simply colored. The one or more areas 505 may be molded with a desired optical characteristic or may be painted or otherwise treated to create the desired optical characteristic. A base 509 may be made of brass, steel or other suitable materials. A twelve gauge shotgun shell is shown, but all gauges of shotgun shells may be used as well as other shell types.

What is claimed is:

1. An ammunition casing comprising:

a base;

a body coupled to the base to create an ammunition casing; and a two-dimensional pattern on a majority of the body for increasing visibility of the casing relative to a solid pattern under selected conditions of use, wherein at least a portion of the two-dimensional pattern is glow-in-the-dark, wherein the portion of the two-dimensional pattern that is glow-in-the-dark is photoluminescent and is not fluorescent.

2. The ammunition casing of claim 1, wherein the two-dimensional pattern is two or more straight parallel stripes.

3. The ammunition casing of claim 2, wherein one or more of the straight parallel stripes is glow-in-the-dark and one or more of the straight parallel stripes is not glow-in-the-dark.

4. The ammunition casing of claim 1, wherein the two-dimensional pattern is two or more spiral stripes.

5. The ammunition casing of claim 4, wherein one or more of the spiral stripes is glow-in-the-dark and one or more of the spiral stripes is not glow-in-the-dark.

6. The ammunition casing of claim 1, wherein the two-dimensional pattern is not a trademark.

7. The ammunition casing of claim 1, wherein the two-dimensional pattern increases visibility related to specific conditions of vegetation, season, or soil coloration.

8. The ammunition casing of claim 1, wherein at least a portion of the two-dimensional pattern is a different color from the portion that is glow-in-the-dark.

9. The ammunition casing of claim 1, wherein the glow-in-the-dark portion of the two-dimensional pattern comprises photoluminescent pigment.

10. The ammunition casing of claim 1, wherein the two-dimensional pattern is created by extruding or co-extruding the two-dimensional pattern in plastic.

11. The ammunition casing of claim 1, wherein the ammunition casing is a loaded ammunition casing.

12. An ammunition casing comprising:

a base;

a body coupled to the base to create a loaded ammunition casing; and a two-dimensional striped pattern on a majority of the body for increasing visibility of the casing relative to a solid pattern under selected conditions of use, wherein one or more stripes are glow-in-the-dark and one or more stripes are not glow-in-the-dark, wherein the portion of the two-dimensional pattern that is glow-in-the-dark is photoluminescent and is not fluorescent.

13. The ammunition casing of claim 12, wherein the two-dimensional pattern is two or more straight parallel stripes.

14. The ammunition casing of claim 12, wherein the two-dimensional pattern is two or more spiral stripes.

15. The ammunition casing of claim 12, wherein the glow-in-the-dark portion of the two-dimensional striped pattern comprises photoluminescent pigment.

16. An ammunition casing comprising:

a base;

a body coupled to the base to create an ammunition casing; and a two-dimensional striped pattern on a majority of the body for increasing visibility of the casing relative to a solid pattern under selected conditions of use, wherein at least a portion of the two-dimensional striped pattern is glow-in-the-dark, wherein the portion of the two-dimensional pattern that is glow-in-the-dark is photoluminescent and is not fluorescent.

17. The ammunition casing of claim 16, wherein the two-dimensional pattern is two or more straight parallel stripes.

* * * * *